US008636062B2

(12) United States Patent
Fripp et al.

(10) Patent No.: US 8,636,062 B2
(45) Date of Patent: Jan. 28, 2014

(54) SYSTEM AND METHOD FOR DOWNHOLE COMMUNICATION

(75) Inventors: Michael L. Fripp, Carrollton, TX (US); Donald Kyle, Plano, TX (US); Pete Dagenais, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 451 days.

(21) Appl. No.: 12/969,379

(22) Filed: Dec. 15, 2010

(65) Prior Publication Data

US 2011/0139445 A1 Jun. 16, 2011

Related U.S. Application Data

(63) Continuation-in-part of application No. 12/574,993, filed on Oct. 7, 2009.

(51) Int. Cl.
*E21B 47/00* (2012.01)
*E21B 47/12* (2012.01)

(52) U.S. Cl.
CPC ..... *E21B 47/12* (2013.01)
USPC ..... 166/250.01; 166/255.1; 166/66

(58) Field of Classification Search
USPC ..... 166/250.01, 255.1, 250.15, 66; 175/45
See application file for complete search history.

(56) References Cited

U.S. PATENT DOCUMENTS 3,638,235 A 1/1972 Lindsey
4,041,780 A 8/1977 Angehrn
4,102,394 A * 7/1978 Botts ..... 166/66
5,038,614 A * 8/1991 Bseisu et al. ..... 73/592
5,377,540 A 1/1995 Songe, Jr. et al.
5,429,190 A 7/1995 Kilgore et al.
5,456,316 A 10/1995 Owens et al.
5,558,153 A 9/1996 Holcombe et al.
5,850,879 A 12/1998 Smith (Continued)

FOREIGN PATENT DOCUMENTS

GB 2447336 A 9/2008
WO 2004013457 A2 2/2004

(Continued)

OTHER PUBLICATIONS

Foreign communication from a related counterpart application—International Search Report and Written Opinion, PCT/US2011/064699, Jul. 30, 2012, 7 pages.

(Continued)

*Primary Examiner* — Cathleen Hutchins
(74) *Attorney, Agent, or Firm* — Scott Wendorf; Conley Rose, P.C.

(57) ABSTRACT

A method of servicing a wellbore extending from a surface and penetrating a subterranean formation is provided. The method comprises placing a assembly in the wellbore, wherein the assembly comprises at least a first downhole tool, a signal receiver subassembly, and a conveyance between the first downhole tool and the surface. The method further comprises the signal receiver subassembly receiving a first signal generated by contact between the wellbore and the assembly and initiating a first function of the first downhole tool based on the first signal.

20 Claims, 5 Drawing Sheets

(56) References Cited

U.S. PATENT DOCUMENTS

| | | | | |
|---|---|---|---|---|
| 5,908,365 | A | 6/1999 | LaJaunie et al. | |
| 6,070,672 | A | 6/2000 | Gazda | |
| 6,151,961 | A | 11/2000 | Huber et al. | |
| 6,199,628 | B1 | 3/2001 | Beck et al. | |
| 6,318,463 | B1 | 11/2001 | Fehrmann et al. | |
| 6,389,890 | B1 | 5/2002 | Sweetland et al. | |
| 6,536,519 | B1 | 3/2003 | Vaynshteyn et al. | |
| 6,608,565 | B1 * | 8/2003 | Van Steenwyk et al. | 340/855.4 |
| 6,710,720 | B2 | 3/2004 | Carstensen et al. | |
| 6,945,330 | B2 | 9/2005 | Wilson et al. | |
| 7,053,787 | B2 | 5/2006 | Schultz et al. | |
| 7,224,289 | B2 | 5/2007 | Bausov et al. | |
| 7,775,285 | B2 | 8/2010 | Surjaatmadja et al. | |
| 8,191,623 | B2 | 6/2012 | Lynde et al. | |
| 8,322,426 | B2 | 12/2012 | Wright et al. | |
| 2003/0010492 | A1 * | 1/2003 | Hill et al. | 166/65.1 |
| 2007/0007016 | A1 | 1/2007 | Sanderlin | |
| 2009/0078413 | A1 | 3/2009 | Tubel et al. | |
| 2010/0175867 | A1 | 7/2010 | Wright et al. | |
| 2011/0079386 | A1 | 4/2011 | Fripp et al. | |
| 2011/0174504 | A1 | 7/2011 | Wright et al. | |

FOREIGN PATENT DOCUMENTS

| | | | |
|---|---|---|---|
| WO | 2007008637 | A1 | 1/2007 |
| WO | 2008085059 | A1 | 7/2008 |
| WO | 2011043981 | A2 | 4/2011 |
| WO | 2011043981 | A3 | 4/2011 |
| WO | 2012082774 | A2 | 6/2012 |
| WO | 2012082774 | A3 | 6/2012 |

OTHER PUBLICATIONS

Foreign communication from a related counterpart application—International Search Report and Written Opinion, PCT/US2010/050963, Sep. 23, 2011, 10 pages.

King, James, et al., "An improved method of slickline perforating," SPE 81536, 2003, pp. 1-4, Society of Petroleum Engineers Inc.

Schlumberger product information, "eFire-Slickline electronic firing head," http://www.slb.com/content/services/perforating/slickline/efire_slickline.asp?, Sep. 29, 2009, 1 page, Schlumberger Limited.

Schlumberger brochure entitled, "eFire-Slickline electronic firing head system," May 2002, 8 pages, Schlumberger.

Schlumberger brochure entitled, "eFire-Slickline firing head," 2008, 2 pages, Schlumberger.

Schlumberger brochure entitled, "eFire-TCP firing system," Apr. 2007, 2 pages, Schlumberger.

Patent application entitled "Well tools operable via thermal expansion resulting from reactive materials," by Adam D. Wright, et al., filed Jan. 15, 2010 as U.S. Appl. No. 12/668,058.

Patent application entitled "Downhole actuator apparatus having a chemically activated trigger," by Adam D. Wright, et al., filed Apr. 28, 2010 as U.S. Appl. No. 12/768,927.

Patent application entitled "System and method for downhole communication," by Michael L. Fripp, et al., filed Oct. 7, 2009 as U.S. Appl. No. 12/574,993.

Foreign communication from a related counterpart application—International Preliminary Report on Patentability, PCT/US2010/050963, Apr. 11, 2012, 8 pages.

Office Action dated Apr. 12, 2013 (26 pages), U.S. Appl. No. 12/574,993, filed Oct. 7, 2009.

* cited by examiner

SYSTEM AND METHOD FOR DOWNHOLE COMMUNICATION

CROSS-REFERENCE TO RELATED APPLICATIONS

This application is a continuation-in-part of U.S. patent application Ser. No. 12/574,993 filed on Oct. 7, 2009 and entitled "System and Method for Downhole Communication," by Michael L. Fripp, et al., which is incorporated by reference herein in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. In some cases, a multilateral well may be drilled comprising a plurality of wellbores drilled off of a main wellbore, each of which may be referred to as a lateral wellbore. Portions of lateral wellbores may be substantially horizontal to the surface. In some provinces, wellbores may be very deep, for example extending more than 10,000 feet from the surface.

A variety of servicing operations may be performed in a wellbore during and after it has been drilled. A lateral junction may be set in the wellbore at the intersection of two lateral wellbores and/or at the intersection of a lateral wellbore with the main wellbore. A casing string may be set and cemented in the wellbore. A liner may be hung in the casing string. A reamer may be run in past an end of the casing string, the reamer deployed, reaming conducted using the reamer, the reamer undeployed, and the reamer removed from the wellbore. A logging tool may be run into the wellbore, activated, and retrieved from the wellbore. The casing string may be perforated by firing a perforation gun. A packer may be set and a formation proximate to the wellbore may be hydraulically fractured or otherwise stimulated. A valve may be shifted. A plug may be set in the wellbore. Those skilled in the art may readily identify additional downhole operations. In many downhole operations, a downhole tool is conveyed into the wellbore to accomplish the needed wellbore servicing operation, for example by some triggering event initiating one or more functions of the downhole tool. Controlling the downhole tool from the surface presents many challenges, and a variety of technical solutions have been deployed.

SUMMARY

In an embodiment, a method of servicing a wellbore and/or operating a tool in a wellbore extending from a surface and penetrating a subterranean formation is provided. The method comprises placing an assembly in the wellbore, wherein the assembly comprises at least a first downhole tool, a signal receiver subassembly, and a conveyance between the first downhole tool and the surface. The method further comprises receiving by the signal receiver subassembly a first signal generated by contact between the wellbore and the assembly and initiating a first function of the first downhole tool based on the first signal.

In an embodiment, a method of servicing a wellbore extending from a surface and penetrating a subterranean formation is provided. The method comprises placing an assembly in the wellbore, wherein the assembly comprises at least one downhole tool, a trigger unit subassembly, and a conveyance between the downhole tool and the surface. The method further comprises analyzing an indication of a speed of the assembly in the wellbore as it changes over time to decode a discrete signal encoded by the motion of the assembly in the wellbore, a first discrete value associated with an indication of the speed of the assembly above a first threshold and a second discrete value associated with an indication of the speed of the assembly less than a second threshold, the second threshold being less than the first threshold. The method further comprises, when the discrete signal matches a trigger number, triggering a function of the downhole tool by the trigger unit subassembly.

In an embodiment, a method of servicing a wellbore extending from a surface and penetrating a subterranean formation is provided. The method comprises placing an assembly in the wellbore, wherein the assembly comprises at least a downhole tool, a signal receiver subassembly, and a conveyance between the downhole tool and the surface, receiving by the signal receiver subassembly an acoustic signal generated by motion of the assembly relative to the wellbore, and initiating a function of the downhole tool based on the acoustic signal.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Figure 1:
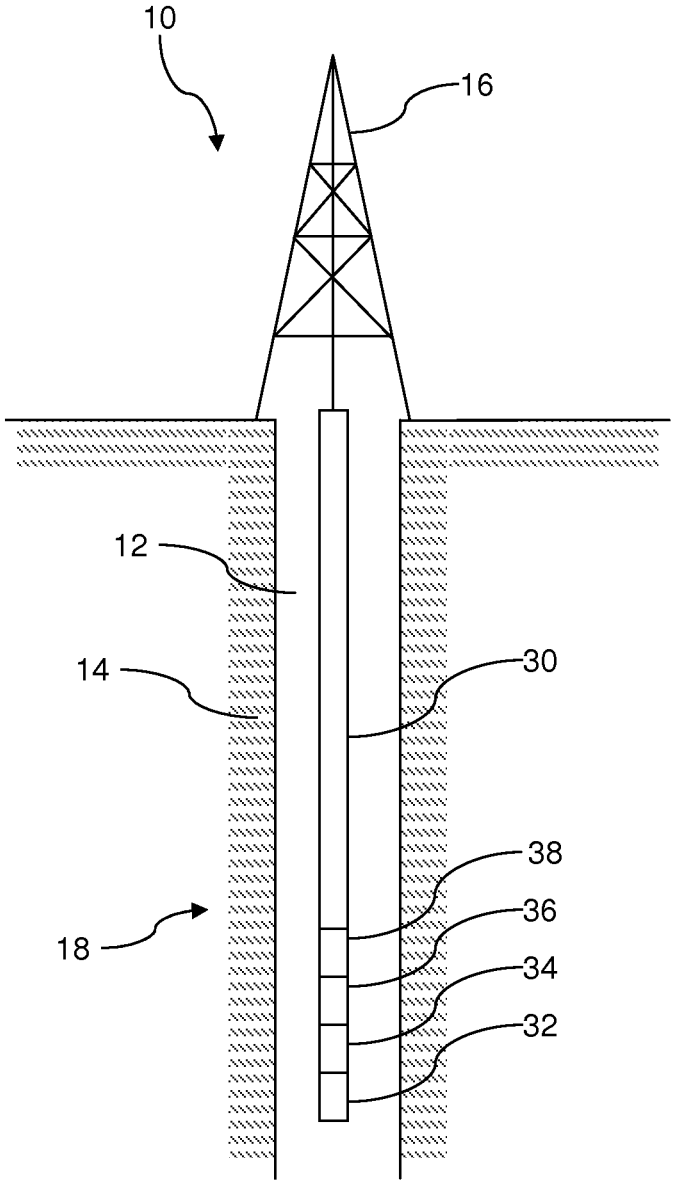
FIG. 1 is an illustration of an assembly according to an embodiment of the disclosure.

Turning now to FIG. 1, a wellbore servicing system 10 is described. The system 10 comprises rig 16 that extends over and around a wellbore 12 that penetrates a subterranean formation 14 for the purpose of recovering hydrocarbons. The wellbore 12 may be drilled into the subterranean formation 14 using any suitable drilling technique. While shown as extending vertically from the surface in FIG. 1, in some embodiments the wellbore 12 may be deviated, horizontal, and/or curved over at least some portions of the wellbore 12. The wellbore 12 may be cased, open hole, contain tubing, and may generally comprise a hole in the ground having a variety of shapes and/or geometries as is known to those of skill in the art.

The rig 16 may be one of a drilling rig, a completion rig, a workover rig, or other mast structure and supports an assembly 18 in the wellbore 12, but in other embodiments a different structure may support the assembly 18. In an embodiment, the rig 16 may comprise a derrick with a rig floor through which the assembly 18 extends downward from the rig 16 into the wellbore 12. In some embodiments, such as in an off-shore location, the rig 16 may be supported by piers extending downwards to a seabed. Alternatively, in some embodiments, the rig 16 may be supported by columns sitting on hulls and/or pontoons that are ballasted below the water surface, which may be referred to as a semi-submersible platform or rig. In an off-shore location, a casing may extend from the rig 16 to exclude sea water and contain drilling fluid returns. It is understood that other mechanical mechanisms, not shown, may control the run-in and withdrawal of the assembly 18 in the wellbore 12, for example a draw works coupled to a hoisting apparatus, a slickline unit or a wireline unit including a winching apparatus, another servicing vehicle, a coiled tubing unit, and/or other apparatus.

In an embodiment, the assembly 18 may comprise a conveyance 30, a first downhole tool 32, and a signal receiver subassembly 34. The conveyance 30 may be any of a string of jointed pipes or tubulars, a slickline, a sandline, a coiled tubing, a wireline, or any other mechanical connection. In another embodiment, the assembly 18 may further comprise a second downhole tool 36, while in yet other embodiments the assembly 18 may comprise additional downhole tools.

The assembly 18 may embody and/or be referred to in some contexts as a tool string, a completion string, a production string, a drilling string, or a workstring. When the first downhole tool 32 is thought by those skilled in the art to be a completion tool, the assembly 18 may be referred to as a completion string. Likewise, when the first downhole tool 32 is thought by those skilled in the art to be a production tool, the assembly 18 may be referred to as a production string. When the first downhole tool 32 is thought by those skilled in the art to be a drilling tool, the assembly 18 may be referred to as drilling string. In some circumstances, those skilled in the art may refer to the assembly 18 as a tool string. In some circumstances, those skilled in the art may refer to the assembly 18 as a workstring. In some cases it is understood that the assembly 18 may comprise a completion tool and/or a production tool. Likewise, in other cases the assembly 18 may comprise subassemblies associated with different wellbore servicing operations and/or different phases of wellbore servicing. As used herein, the assembly 18 is explicitly understood to comprise any of these different strings and/or combinations of these different strings and to generally refer to any string of coupled (e.g., mechanically connected, mechanically coupled, mechanically linked, and other mechanical association) and/or operationally connected devices that are deployed into the wellbore 12 from the surface.

In an embodiment, the assembly 18 further comprises a mechanical vibration source 38. The signal receiver subassembly 34, in combination with other components depicted in FIG. 1, may provide an efficient, reliable, and user friendly communication downlink from the surface to the downhole tools 32, 36. It is understood that the downhole tools 32, 36, the signal receiver subassembly 34, and/or the mechanical vibration source 38 may be utilized in vertical, horizontal, curved, inverted, or inclined orientations without departing from the teachings of the present disclosure. In an embodiment, the signal receiver subassembly 34 may be incorporated into and/or integrated with one of the downhole tools 32, 36. For example, in an embodiment, the signal receiver subassembly 34 and the first downhole tool 32 may share one or more of a housing, a power supply, a memory, a processor, and/or other components.

In some embodiments, the wellbore 12 may be lined with a casing (not shown) that is secured into position against the subterranean formation 14 in a conventional manner using cement. In an embodiment, the downhole tools 32, 36 and/or the assembly 18 may be moving through a tubing that is located within the casing.

When the first downhole tool 32 has been run-in to a target depth in the wellbore 12, to activate and/or trigger performance of a first function by the first downhole tool 32, a signal is communicated from the surface to the signal receiver subassembly 34, and the signal receiver subassembly 34 then triggers the first function of the first downhole tool 32. The present disclosure teaches communicating the signal from the surface by manipulating the assembly 18 and/or the conveyance 30 in the wellbore 12. For example, the signal may comprise a discrete signal that is encoded as a sequence of different velocities. In an embodiment, a velocity in excess of a first defined threshold, either uphole or downhole, may encode a first discrete value, and a velocity less than the first defined threshold, either uphole or downhole, may encode a second discrete value. Alternatively, in another embodiment, a velocity in excess of the first defined threshold, either uphole or downhole, may encode the first discrete value, and a velocity less than a second defined threshold, where the second defined threshold is less than the first defined threshold, either uphole or downhole, may encode a second discrete value.

In an embodiment, the signal may comprise a discrete signal that is encoded as a sequence of different speeds. As is known to those of skill in the art, speed is a scalar quantity and is related to the velocity of an object as the amplitude of the velocity without consideration to the direction of the velocity. In an embodiment, a speed in excess of a first defined threshold may encode a first discrete value, and a speed less than the first defined threshold may encode a second discrete value. Alternatively, a speed in excess of the first defined threshold may encode a first discrete value, and a speed less than a second defined threshold may encode a second discrete value, where the second defined threshold is less than the first defined threshold.

In some circumstances, using two different thresholds may increase the reliability of downhole communication. In an embodiment, the first discrete value may be a $0_2$ and the second discrete value may be a $1_2$. Alternatively, in another embodiment, the first discrete value may be a $1_2$ and the second discrete value may be a $0_2$. In an embodiment, the thresholds may be adaptive and may change in the downhole environment in response to mechanical vibration and/or mechanical noise levels, signal levels, the previous signal path, the rate of change of the signal amplitude, and other downhole environment parameters. In another embodiment, the discrete signal may be encoded as a sequence of different rotational velocities, a sequence of different axial velocities, or a sequence comprised of a combination of two or more of different linear velocities, different rotational velocities, and different axial velocities.

In another embodiment, a greater amount of information may be encoded in the motion of the assembly 18. For example, a third discrete value may be encoded by a speed less than a third defined threshold, a fourth discrete value may be encoded by a speed greater than a fourth defined threshold and less than a fifth defined threshold, a fifth discrete value may be encoded by a speed greater than a sixth defined threshold and less than a seventh defined threshold, and a sixth discrete value may be encoded by a speed greater than an eighth defined threshold, where the speed is a scalar quantity that disregards the sense of direction of the velocity. In an embodiment, the third discrete value may be $00_2$, the fourth discrete value may be $01_2$, the fifth discrete value may be $10_2$, and the sixth discrete value may be $11_2$. Those skilled in the art will appreciate that other similar encodings are possible, all of which are contemplated by the present disclosure. By manipulating the assembly 18 at the surface in a sequence of up and down motions or in a sequence of rotational movements, a multiple digit discrete number may be communicated to the signal receiver subassembly 34.

While the discussion above was directed to digital communication employing a binary base or a base 2 encoding scheme, in an embodiment, a different base of numerical representation may be employed, for example the signals may be encoded in base 3. A $0_3$ value could be encoded by no movement, a $1_3$ value could be encoded by a downhole movement, and a $2_3$ value could be encoded by an uphole movement. Appropriate bounding thresholds may likewise be defined for such a base 3 representation system to provide excluded values to decrease the probability of erroneous signal transmissions. One skilled in the art will readily appreciate that other numerical bases may be employed to encode the communication signals, all of which are contemplated by the present disclosure.

It has been observed that relying on accelerating the assembly 18 uphole-downhole and/or encoding the communication to the signal receiver subassembly 34 in a sequence of accelerations of the assembly 18 uphole-downhole may become unreliable when the assembly 18 is of great length, as for example in a deep well or in a lateral wellbore that accesses a production zone displaced a considerable distance away from the main wellbore. This may result from the large mechanical spring and damper properties associated with the assembly 18 when it becomes long. The settling time of the assembly 18 is longer for a longer assembly 18. For example, manipulation of the assembly 18 at the surface to impart a controlled acceleration to the assembly 18 uphole-downhole may result in a different acceleration at the signal receiver subsystem 34, as the acceleration is altered by mechanical spring and damper effects. Additionally, relying upon uphole-downhole accelerations, which in some contexts may be referred to as gross accelerations to distinguish from the minor displacements of accelerations associated with mechanical vibrations, to communicate to the signal receiver subassembly 34 may be sensitive to precise axial alignment of an accelerometer with the assembly 18. Due to the high costs involved in servicing wellbores 12 and/or delays of putting a well on production, reliability is an important consideration in designing a downhole communication apparatus.

In an embodiment, the signal receiver subassembly 34 may comprise one or more velocity sensors and/or speed sensors. The velocity sensors and/or speed sensors may be one or more of a flow velocity transducer, fluid flow transducer, a rolling wheel transducer, an optical scanner, a magnetic field transducer, a ferroelectric transducer, a gamma ray transducer, and other transducers effective for producing an indication of a velocity of the signal receiver subassembly 34 and/or other components of the assembly 18. In an embodiment, the velocity sensors and/or speed sensors may additionally comprise one or more of a gravitational sensor, a magnetic field sensor, or a pressure sensor. Alternatively, rather than the signal receiver subassembly 34 comprising the velocity sensor and/or speed sensor, the velocity sensor and/or speed sensor may be a separate subassembly in the assembly 18 that is communicatively coupled to the signal receiver subassembly 34.

In an embodiment, the velocity sensor and/or sensors detect a velocity of the assembly 18 proximate to the first downhole tool 32 and communicate this value to the signal receiver subassembly 34. In some embodiments, the velocity sensor may communicate a value that is an analog of the velocity of the assembly 18, which may be referred to as an indication of velocity, to the signal receiver subassembly 34, and the signal receiver subassembly 34 may process this value to determine and/or calculate the velocity of the assembly 18 based on the value. In other embodiments, the velocity sensor may communicate a value that is an analog of the displacement and/or position of the assembly 18 in the wellbore 12 to the signal receiver subassembly 34, and the signal receiver subassembly 34 may process this value and/or a sequence of these values to determine and/or calculate the velocity of the assembly 18 based on the value and/or values. In an embodiment, the indications of motion provided by one or more of a gravitational sensor, magnetic field sensor, and a pressure sensor may also be processed and used in combination with other indications to calculate the velocity of the assembly 18. In an embodiment, the velocity of the assembly 18 may not be calculated or determined, and the indication of velocity may be used to decode the signal transmitted from the surface. It will be appreciated that statements corresponding those made above with reference to a velocity sensor may be made with respect to a speed sensor.

In an embodiment, the signal receiver subassembly 34 processes the velocity and/or speed of the assembly 18 to decode the signal communicated from the surface. Decoding the signal communicated from the surface may involve one or more of a variety of signal processing and/or signal conditioning operations comprising, but not limited to, sensing and/or transducing a physical quality or phenomenon into an electrical signal, analog to digital conversion of the signal, optionally frequency filtering the electrical signal, determining a discrete number in the electrical signal, and comparing the discrete number to one or more stored numbers, which in some contexts may be referred to as trigger numbers, to determine that activation of a selected function of one or more of the downhole tools has been commanded. In an embodiment, the mechanical signal experienced by the assembly 18 and/or the signal receiver subassembly 34 may be mechanically filtered by mechanical mechanisms coupled to the assembly 18. Mechanical filtering may be performed by spring and/or damper materials coupled to and/or enclosing the assembly 18 and/or the signal receive subassembly 34.

Velocity is distinguished from acceleration in a variety of ways. Mathematically, acceleration is the first derivative of velocity. A constant velocity, uphole or downhole or rotationally, corresponds to a zero acceleration value. Practically speaking, in some circumstances it is easier to impart and maintain a controlled, reliable velocity to the assembly 18 proximate to the first downhole tool 32 than to impart and maintain a controlled, reliable acceleration to the assembly 18 proximate to the first downhole tool 32, for example when the assembly 18 is long and large spring and damper effects are involved at the point in the assembly 18 proximate to the first downhole tool 32, for example where an acceleration sensor may be located. It may be easier to establish and maintain a standard velocity for an interval of time—for example for five seconds—than to maintain a standard acceleration for the same interval of time.

In another embodiment, the signal receiver subassembly 34 may infer the velocity and/or speed of the assembly 18 proximate to the first downhole tool 32 based on a sensed amplitude of a mechanical vibration incident upon the assembly 18 proximate to the first downhole tool 32. In some contexts, the mechanical vibration may be referred to as a mechanical noise. In some contexts, the mechanical vibration may be referred to as road noise, by analogy with the general rumble heard in the interior of a wheeled vehicle traveling over the road. In some contexts, the mechanical vibration may be referred to as an acoustic signal. Acoustic signals and/or acoustic energy may be characterized as propagating substantially as a longitudinal wave. The motion of the assembly 18 proximate to the first downhole tool 32 in the wellbore 12 may produce mechanical vibrations and/or mechanical noise, for example as the outer surface of the assembly 18 contacts and rubs against the wellbore 12. The mechanical vibrations produced by motion of the assembly 18 in the wellbore 12 may be substantially similar whether the assembly 18 is moving uphole, downhole, clockwise, or counter-clockwise. In an embodiment, an asymmetrical motion profile may be induced in the assembly 18 to produce vibrations that have a different amplitude and/or frequency based on the direction of travel of the assembly 18.

In an embodiment, the discrete signal described above may be generated by contact between the wellbore 12 and the assembly 18, wherein the contact that generates the discrete signal is created predominantly by axial motion of the assembly 18 in the wellbore 12 (e.g., motion substantially parallel to the axis of the assembly 18). In another embodiment, the discrete signal described above may be generated by contact between the wellbore 12 and the assembly 18, wherein the contact that generates the discrete signal is created predominantly by rotational motion of the assembly 18 in the wellbore 12. The alignment of the motion of the assembly 18 may or may not correlate with the alignment of the mechanical vibration energy and/or mechanical noise and/or road noise detected by the signal receiver subassembly 34.

In some circumstances, manipulating the assembly 18 and/or the conveyance 30 proximate to the surface to induce the mechanical vibration and/or mechanical noise may be a more robust and reliable communication signal than the acceleration of the assembly 18 and/or the conveyance 30. For example, in a deep wellbore, the acceleration of the assembly 18 and/or the conveyance 30 at the surface may be substantially altered by the large spring and damper effects associated with the great length of the assembly 18. For example, an acceleration impulse at the surface may be reduced in amplitude and spread in time at a point in the assembly 18 proximate to the first downhole tool 32.

In an embodiment, the digital signal communicated from the surface may be framed by time intervals. For example, the digital signal may be composed of an ordered sequence of digital symbols, where each digital symbol is communicated within a specific time interval. For, example, but not by way of limitation, the digital signal may be communicated in a series of 20 second time intervals where the digital signal is determined during a central portion of the subject time interval or during an end portion of the subject time interval. By ignoring the value during an initial portion of the subject time interval, the assembly 18 may have an opportunity to reach a constant velocity and/or speed before the digital symbol is received by the signal receiver subassembly 34, thereby allowing spring and damper effects to settle out and allowing gross acceleration to approach zero. In an embodiment, a 20 second symbol period may be employed, and the digital symbol may be received during the time interval from 8 seconds after the start of the symbol period to 12 seconds after the start of the symbol period. In another embodiment, the 20 second symbol period may be employed, and the digital symbol may be received during the timer interval from 14 seconds after the start of the symbol period to 18 seconds after the start of the symbol period. In other embodiments, a different length of symbol period may be employed and the digital symbol may be sampled and/or received at a different point within the symbol period. In an embodiment, a frame synchronization signal may be communicated from the surface before sending the digital signals to the signal receiver subassembly 34, for example a known sequence of 1's and 0's, to permit the signal receiver subassembly 34 to adjust its sense of time intervals with that of the surface.

In an embodiment, the signal receiver subassembly 34 may comprise one or more mechanical vibration sensors. The mechanical vibration sensors may be one or more of an accelerometer, a voice coil, a piezoceramic transducer, a magnetostrictive sensor, a ferroelectric transducer, and a strain gauge. Alternatively, rather than the signal receiver subassembly 34 comprising the mechanical vibration sensor, the mechanical vibration sensor may be a separate subassembly in the assembly 18 that is communicatively coupled to the signal receiver subassembly 34. The mechanical vibration sensor and/or sensors detect the amplitude of the mechanical vibration of the assembly 18 proximate to the downhole tool 32 and communicates this value to the signal receiver subassembly 34, and the signal receiver subassembly 34 processes the value to decode the signal communicated from the surface.

In an embodiment, the mechanical vibration sensor may be an accelerometer and may be oriented substantially radially and/or perpendicularly with reference to the axis of the assembly 18. It is thought that the mechanical vibration associated with movement of the assembly 18 in the wellbore 12 is substantially radially oriented and substantially orthogonal to the axis of the assembly 18. At the same time, it is also thought that the energy of the mechanical vibration associated with movement of the assembly 18 in the wellbore 12 is distributed, at least in part, in all orientations, thereby making the function of the accelerometer for sensing this mechanical vibration relatively insensitive to precise orientation of the accelerometer.

In an embodiment, the mechanical vibration source 38 may be incorporated into the assembly 18. The mechanical vibration source 38 then moves with the assembly 18 and produces mechanical vibration and/or mechanical noise in response to motion of the mechanical vibration source 38 in the wellbore 12. The mechanical vibration source 38 may provide either a more consistent mechanical vibration or a mechanical vibration having particular properties, for example a mechanical vibration having particular frequency properties or having a particular alignment and/or orientation. In an embodiment, the signal receiver subassembly 34 may be designed and/or programmed to identify the particular frequency that the mechanical vibration source 38 is designed to enhance, for example, the signal receiver subassembly 34 may perform frequency selective filtering to exclude and/or attenuate frequencies outside the main frequency bandwidth of the mechanical vibration frequency generated by the mechanical vibration source 38 and to pass the frequencies in the main frequency bandwidth of the mechanical vibration generated by the mechanical vibration source 38. This may contribute to fewer spurious signals being interpreted by the signal receiver subassembly 34 as valid communication symbols from the surface. The mechanical vibration source 38 may comprise at least one of an extended probe, a wheel that actuates a mechanical noise maker, a rattle, a revolving member, a propeller, a centralizer, a decentralizer, and other like mechanical contrivances for promoting mechanical vibrations and/or mechanical noise and/or an acoustic signal.

In an embodiment, the signal receiver subassembly 34 may process the sensed mechanical vibration through a high pass filter to attenuate the low frequency components of the mechanical vibration. In an embodiment, the high pass filter may be implemented as an analog filter comprised of inductive, resistive, and capacitive elements. Alternatively, in another embodiment, the high pass filter may be implemented as a digital filter. The signal receiver subassembly 34 or another component of the assembly 18 may convert the mechanical vibration or acoustic signal to an electrical signal and process the electrical signal through the high pass filter to produce a filtered electrical signal. Alternatively, in an embodiment, the electrical signal may be converted to a digital signal and the digital signal may be processed by a high pass digital filter to produce a filtered digital signal. In an embodiment, the high pass filter may have a cut-off frequency of about 10 Hertz (Hz). The cut-off frequency of the high pass filter may be the point where low frequency components of the sensed mechanical vibration and/or the electrical signal associated with the sensed mechanical vibration are attenuated by at least 3 decibels (dB). In another embodiment, however, the high pass filter may have a cut-off frequency of about 50 Hz. In another embodiment, however, the high pass filter may have a cut-off frequency of about 100 Hz. In another embodiment, the high pass filter may have a cut-off frequency of about 200 Hz. In another embodiment, the high pass filter may have a cut-off frequency of about 500 Hz. In an embodiment, the high pass filter is configured to pass audio frequencies and to attenuate and/or reject sub-audio frequencies. The audio frequency band is associated with the frequency band from 20 Hz to 20,000 Hz by some. Others associate the audio frequency band with a narrower frequency band, for example from about 50 Hz to 16,000 Hz. Yet others may associate the audio frequency band with a yet narrower frequency band, for example from about 100 Hz to about 12,000 Hz.

In some initial testing, it appears that a significant amount of the energy of the sensed mechanical vibration associated with motion of the assembly 18 in the wellbore 12 is concentrated in the audio frequency range. More particularly, a significant amount of the energy of the sensed mechanical vibration associated with the motion of the assembly 18 in the wellbore 12 is located above about 500 Hz. It has been found that the energy of the sensed mechanical vibration that can be ascribed to a variety of events unrelated to motion of the assembly 18 uphole and downhole in the wellbore 12, which may be referred to as spurious events, is concentrated in the sub-audio frequency range, for example below 10 Hz. Additionally, the energy of the sensed mechanical vibration that can be ascribed to gross acceleration of the assembly 18 is also concentrated in the sub-audio frequency range. The present disclosure teaches setting the cut-off frequency of the high pass filter at a frequency that is effective to attenuate and/or reject the sensed mechanical vibration associated with spurious events and gross accelerations while passing the sensed mechanical vibration associated with motion of the assembly 18 uphole and downhole in the wellbore 12. An example of a spurious event is a momentary collision of a collar or a joint between subassemblies in the assembly 18 with a protrusion in the wellbore 12. In an embodiment, the signal receiver subassembly 34 may be said to detect a frequency generated by contact of the assembly 18 and/or the first downhole tool 32 with the wellbore 12 to determine a trigger for the first downhole tool 32.

In an embodiment, the signal receiver subassembly 34 high pass filters the sensed mechanical vibration, which may be referred to as a source signal, to produce a first derived signal. In an embodiment, the signal receiver subassembly 34 may produce the first derived signal by bandpass filtering the mechanical vibration to attenuate frequencies below a first cutoff frequency and to attenuate frequencies above a second cutoff frequency, where the second cutoff frequency is higher than the first cutoff frequency, for example when the mechanical vibration source 38 enhances the energy of mechanical vibration within the pass band of the bandpass filter. The signal receiver subassembly 34 may rectify and/or calculate the absolute value of the first derived signal to produce a second derived signal. The second derived signal may be considered to be an energy signal. The signal receiver subassembly 34 may average and/or low pass filter the second derived signal to produce a third derived signal. The signal receiver subassembly 34 may threshold detect the third derived signal to produce a fourth derived signal. The signal receiver subassembly 34 may process the fourth derived signal to generate the binary ones and zeroes of the transmitted binary number or values of the transmitted signals in some other discrete number system. In an alternative embodiment, some of the processing described above may be omitted. In yet another embodiment, some of the processing described above as occurring separately and/or sequentially may be combined and/or may be performed in a different sequence from that described above.

The signal receiver subassembly 34 processes either the sensed velocity, the sensed speed, or the sensed mechanical vibration of the assembly 18 proximate to the first downhole tool 32 to receive the signal transmitted from the surface, for example a multi-digit discrete number. For example, a velocity or speed value greater than a threshold value may be decoded as a first binary value while a velocity or speed value less than the threshold value may be decoded as a second binary value. Alternatively, a mechanical vibration value greater than a threshold value may be decoded as a first binary value and a mechanical vibration value less than the threshold value may be decoded as a second binary value. Note that while the mechanical vibration may be used to infer a velocity and/or speed of the assembly 18 proximate to the first down hole tool 32, in at least some embodiments the signal receiver subassembly 34 need not convert the sensed mechanical vibration to an equivalent velocity or speed to decode the binary signal transmitted from the surface, and the signal receiver subassembly 34 may decode the binary signal directly based on the sensed mechanical vibration. Without limitation of the present disclosure, providing a communication down link from the surface to the downhole tools 32, 36 and/or the signal receiver subassembly 34 based on mechanical vibration is expected to have particular advantages in inclined and/or horizontal wellbores 12, where there is a natural tendency of the assembly 18 to contact and rub against the wellbore 12 on the side attracted by the earth's gravitational field, thereby establishing a distinct and ample mechanical vibration.

The signal receiver subassembly 34 compares the received discrete number to a trigger number, for example a binary number that was programmed or configured into the signal receiver subassembly 34 before deploying downhole in the assembly 18. When the signal receiver subassembly 34 determines that the received discrete number matches the trigger number, the signal receiver subassembly 34 communicates a triggering signal, a triggering command, and/or an actuation signal to the first downhole tool 32. The first downhole tool 32 then activates and performs the subject function in response to receiving the triggering signal from the signal receiver subassembly 34. In some contexts, the signal receiving subassembly 34 may be referred to as a trigger unit or a trigger subassembly.

In an embodiment, the signal receiver subassembly 34 may be configured with a plurality of different trigger numbers. In this case, the signal receiver subassembly 34 may selectively activate different functions of the first downhole tool 32 and/or functions performed by different downhole tools. For example, in an embodiment, a first trigger number may be associated with a first function of the first downhole tool 32 and a second trigger number may be associated with a second function of the first downhole tool 32. In another embodiment, a third trigger number may be associated with a third function of the first downhole tool 32 and a fourth trigger number may be associated with a fourth function of the second downhole tool 36.

The trigger number may have any number of discrete digits. Increasing the number of discrete digits in the trigger number has the effect of increasing the reliability and robustness of the communication downhole but has the drawback of increasing the complexity of manipulating the assembly 18 at the surface to transmit the signal downhole. In combination with the present disclosure, one skilled in the art will readily determine an effective number of discrete digits from which to compose the trigger number, based in part on experience and the special operating conditions of the subject wellbore servicing system 10. In an embodiment, the trigger number may be configured into the signal receiver subassembly 34 by a wired and/or a wireless link to a computer or mobile handset at the location of the system 10, at a depot shop, or at a laboratory. In an embodiment, the configuration of the trigger number(s) into the signal receiver subassembly 34 may include an optional or a mandatory step of erasing the memory location for storing trigger numbers, to avoid any possibility of leaving obsolete trigger numbers active in the signal receiver subassembly 34.

The downhole tools 32, 36 may be one of a completion tool, a drilling tool, a stimulation tool, an evaluation tool, a safety tool, an abandonment tool, a packer, a bridge plug, a setting tool, a perforation gun, a casing cutter, a flow control device, a sampler, a sensing instrument, a data collection device and/or instrument, a measure while drilling (MWD) tool, a log while drilling (LWD) tool, a drilling tool, a drill bit, a reamer, a stimulation tool, a fracturing tool, a production tool, and other downhole tools. In an embodiment, the assembly 18 may comprise a stimulation tool that has one or more sliding sleeves. A stimulation tool that has one or more sliding sleeves suitable for use in the assembly 18 is described in U.S. patent application Ser. No. 12/274,193 filed Nov. 19, 2008, entitled "Apparatus and Method for Servicing a Wellbore," by Jim B. Surjaatmadja, et al., which is incorporated herein by reference for all purposes. In some contexts the stimulation tool with one or more sliding sleeves may be referred to as a DELTA STIM tool available from Halliburton Energy Services.

The downhole tools 32, 36 may be actuated in response to the trigger signal generated by the signal receiver subassembly 34 by any of a variety of actuating devices and/or contrivances. In an embodiment, the actuating devices may be considered to be part of the downhole tools 32, 36. Alternatively, the actuating devices may be considered to be separate from the downhole tools 32, 36 and may be instead considered to be a separate component or separate components that, together with the downhole tools 32, 36, may form a sub-assembly or sub-assemblies of the assembly 18. Some suitable actuating devices are described in U.S. patent application Ser. No. 12/768,927 filed Apr. 28, 2010 and entitled "Downhole Actuator Apparatus Having a Chemically Activated Trigger," by Adam Wright, et al., U.S. patent application Ser. No. 12/688,058 filed Jan. 15, 2010 and entitled "Well Tools Operable via Thermal Expansion Resulting from Reactive Materials," by Adam Wright, et al., and U.S. patent application Ser. No. 12/353,664 filed Jan. 14, 2009 and entitled "Well Tools Incorporating Valves Operable by Low Electrical Power Input," by Adam Wright, et al., all three of which are incorporated herein by reference for all purposes.

The functions of the downhole tools 32, 36 that the signal receiver subassembly 34 may activate may comprise any of initiating detonation of a perforation gun, opening or closing a valve, opening or closing a sliding sleeve, causing a setting tool to set and/or release, starting collection of data, stopping collection of data, starting transmission of data, stopping transmission of data, activating and/or deactivating an electronic device, broaching a fluid bulkhead, breaking a rupture disk, and others. The downhole tools 32, 36 may promote a variety of wellbore services including, but not by way of limitation, hanging a liner, cementing, stimulation, hydraulic fracturing, acidizing, gravel packing, setting tools, setting lateral junctions, perforating casing and/or formations, collecting data, transmitting data, drilling, reaming, and other services.

In an embodiment, the signal receiver subassembly 34 may receive an indication of an environmental parameter, for example temperature and/or pressure, for example from one or more environment sensors incorporated into the assembly 18. The signal receiver subassembly 34 may enable and/or disable outputting the triggering signal to the downhole tools 32, 36 based on the value of the environmental parameters. For example, the signal receiver subassembly 34 may disable outputting the triggering signal to the downhole tools 32, 36 when the sensed temperature exceeds 700 degrees Fahrenheit, for example during a fire. As another example, the signal receiver subassembly 34 may disable outputting the triggering signal when the sensed pressure is less than 10 atmospheres, for example to avoid outputting an erroneous triggering signal while the downhole tools 32, 36 are not deployed sufficiently far into the wellbore 12.

In an embodiment, the downhole tools 32, 36 may be triggered and/or activated by a shared signal receiver subassembly 34. Alternatively, in an embodiment, the assembly 18 may comprise a plurality of signal receiver subassemblies 34, for example one signal receiver subassembly per downhole tool and/or one signal receiver subassembly per distinct function to be triggered. In an embodiment, the signal receiver subassemblies 34 may communicate with the downhole tool 32, 36 by a variety of communication means including, but not limited to, wireless communication, wired communication, acoustic telemetry, pressure pulse communication, and other. In an embodiment, the signal receiver subassembly 34 comprises a computer in a sealed inner chamber. Computers are discussed in more detail hereinafter.

Figure 2:
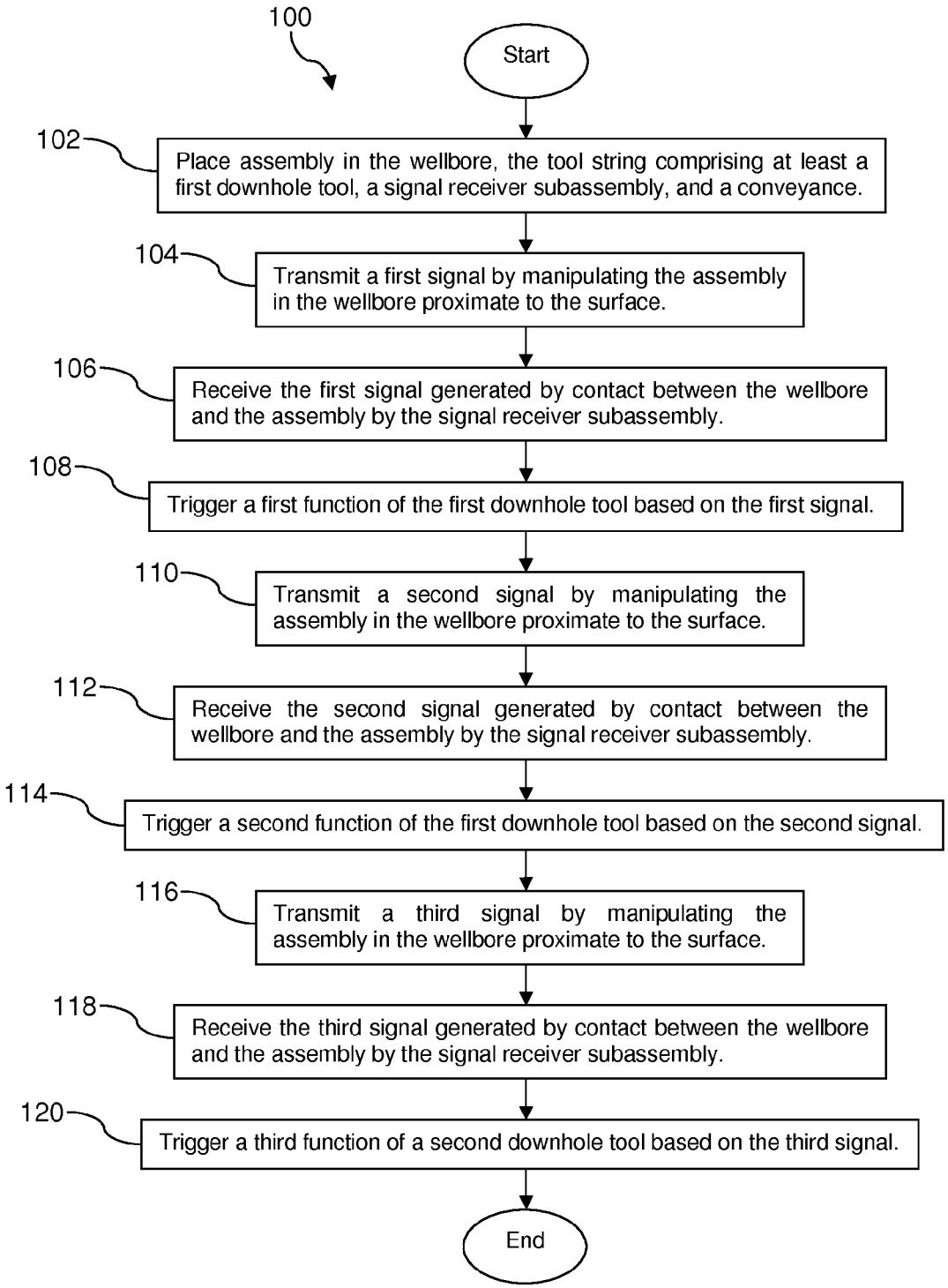
FIG. 2 is a flow chart of a method according to an embodiment of the disclosure.

Turning now to FIG. 2, a method 100 is described. At block 102, the assembly 18 is placed in the wellbore 12. The assembly 18 comprises at least the first downhole tool 32, the signal receiver subassembly 34, and the conveyance 30. In an embodiment, placing the assembly 18 in the wellbore 12 may include the steps of assembling, making up, and/or building the assembly 18 from the several components, for example coupling the first downhole tool 32, the signal receiver subassembly 34, and the conveyance 30 together. In an embodiment, the conveyance 30 may comprise a number of joints of pipe, and placing the assembly 18 in the wellbore 12 may further comprise threadingly coupling the joints of pipe together to make up the conveyance 30. As described above, however, the conveyance 30 may alternatively comprise slickline, wireline, or coiled tubing. In an embodiment, placing the assembly 18 in the wellbore 12 may include configuring one or more trigger numbers into the signal receiving subassembly 34. Placing the assembly 18 in the wellbore 12 may comprise running-in the first downhole tool 32 to a target depth for performing a wellbore servicing operation using the first downhole tool 32.

At block 104, a first signal is transmitted by manipulating the assembly 18 in the wellbore 12 proximate to the surface. For example, a draw works coupled to a hoisting apparatus supported by the rig 16 may move the assembly 18 uphole during a first time interval to transmit a first discrete value, for example a $1_2$ discrete value. The draw works may hold the assembly 18 substantially steady during a second time interval to transmit a second discrete value, for example a $0_2$ discrete value. Note that to encode two successive discrete values having the same value, the draw works may move the assembly 18 uphole substantially continuously or hold the assembly 18 steady during two discrete symbol intervals. In an embodiment, moving the assembly 18 uphole or downhole may encode the same discrete value. Alternatively, in an embodiment, other associations of motion and/or mechanical vibration to discrete values may be employed. For example, to encode two successive discrete values having the same value, the draw works may move the assembly 18 uphole for a period of time, pause to denote the end of the first bit, and then move the assembly 18 uphole for a second period of time.

In an embodiment, a different base of numerical representation may be employed, for example the signals may be encoded in base 3. A $0_3$ value could be encoded by no movement, a $1_3$ value could be encoded by a downhole movement, and a $2_3$ value could be encoded by an uphole movement. One skilled in the art will readily appreciate that, likewise, other numerical bases may be employed to encode the communication signals, all of which are contemplated by the present disclosure.

In some embodiments, moving the assembly 18 in the wellbore 12 to transmit the first discrete value means moving the assembly 18 with at least a threshold velocity and/or speed uphole or down hole, and holding the assembly 18 steady in the wellbore 12 to transmit the second discrete value means keeping the uphole and downhole velocity of the assembly 18 less than a threshold velocity. The first signal is transmitted by manipulating the assembly 18 in the wellbore 12 to send a sequence of discrete values. It is understood that, in an embodiment, transmitting the first signal is understood to comprise generating mechanical vibration proximate the first downhole tool 32 at least in part by moving contact between portions of the assembly 18 and the wellbore 12. In another embodiment, transmitting the first signal is understood to comprise generating an acoustic signal by motion of the assembly 18 relative to the wellbore 12. In an embodiment, before transmitting the first signal, the assembly 18 may be manipulated in the wellbore 12 proximate to the surface to sending a framing signal, for example a regular pattern of 1's and 0's, to promote the signal receiving subassembly 34 synchronizing to the discrete symbol frame time being observed at the surface.

At block 106, the first signal is received by the signal receiver subassembly 34. In an embodiment, the first signal may be received by the signal receiver subassembly 34 as at least one of an indication of velocity and/or speed of the assembly 18 proximate to the first downhole tool 32 and an indication of the mechanical vibration incident upon the first downhole tool 32. In some contexts it may be said that the first signal is generated by contact between the assembly 18 and the wellbore 12. In another embodiment, however, contact between the assembly 18 and the wellbore 12 is not required to generate an acoustic signal that may be relied upon to decode the signal transmitted from the surface.

At block 108, a first function of the first downhole tool 32 is triggered based on the first signal. For example, the signal receiver subassembly 34 receives the first signal, decodes the discrete number contained in the first signal, compares the discrete number to the trigger value configured into the signal receiver subassembly 34, determines a match between the discrete number and the trigger value, and communicates the triggering signal to the first downhole tool 32 to actuate a first function of the first downhole tool 32, for example to initiate detonation of a perforation gun. The signal receiver subassembly 34 may communicate the trigger signal to an actuating device that forms part of the first downhole tool 32. Alternatively, the signal receiver subassembly 34 may communicate the trigger signal to an actuating device coupled to the first downhole tool 32, for example an actuating device that together with the first downhole tool 32 defined a subassembly of the assembly 18.

In blocks 110, 112, and 114, optionally, a second signal is transmitted, the second signal is received, and a second function of the first downhole tool 32 is actuated similarly to blocks 104, 106, and 108 above. In an embodiment, the signal receiver subassembly 34 may be configured with a plurality of trigger numbers linked to specific functions and/or specific downhole tools 32, 36. When the second signal is decoded and determined to contain a second trigger value associated with a second function of the first downhole tool 32, the signal receiver subassembly 34 communicates the triggering signal to the first downhole tool 32 to actuate the second function of the first downhole tool 32.

In blocks 116, 118, and 120, optionally, a third function of the second downhole tool 36 is actuated by communication from the signal receiver subassembly 34 similarly to blocks 110, 112, and 114. After a desired number of functions of one or more downhole tools have been triggered in a manner similar to that described above, the method 100 then exits.

Figure 3:
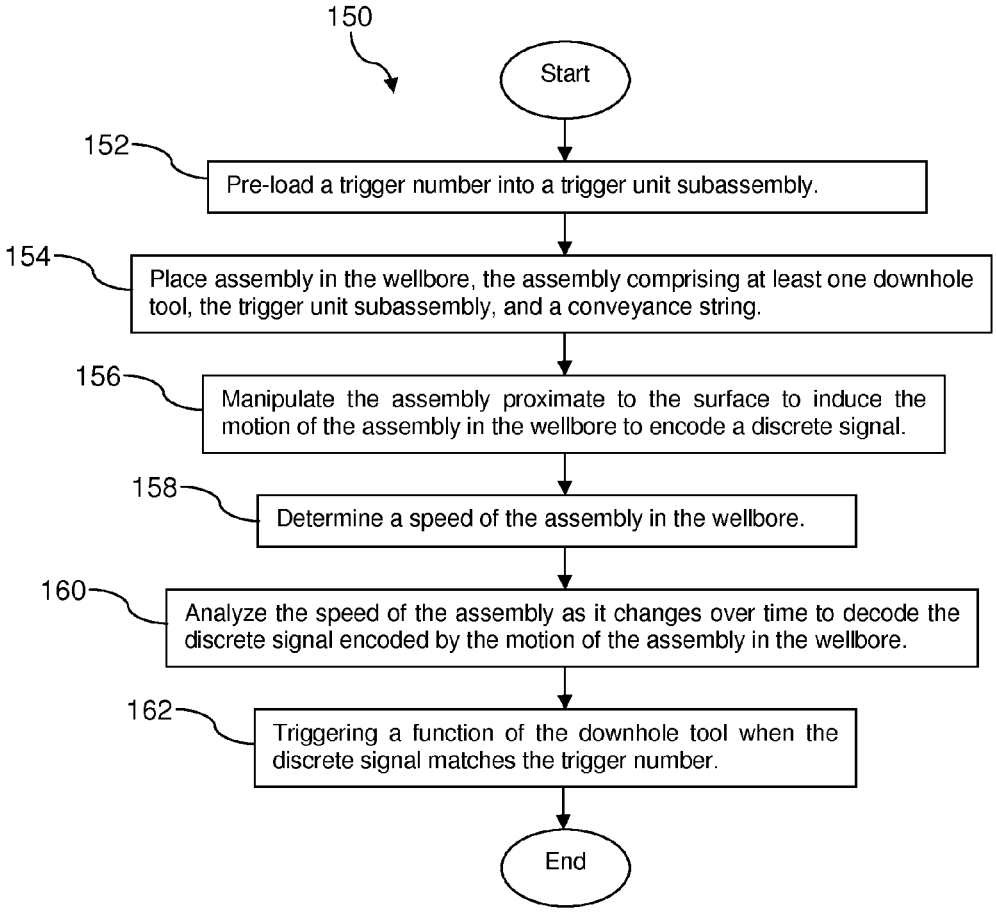
FIG. 3 is a flow chart of another method according to an embodiment of the disclosure.

Turning now to FIG. 3, a method 150 is described. At block 152, a trigger number is pre-loaded and/or configured into a trigger unit subassembly, for example into the signal receiver subassembly 34. In an embodiment, the trigger unit subassembly and the signal receiver subassembly 34 may be the same. Alternatively, in an embodiment, the trigger unit subassembly may comprise a plurality of components, one component of which is the signal receiver subassembly 34. For example, in an embodiment, the trigger unit subassembly may comprise the signal receiver subassembly 34 and one or more of the actuating devices described above. This step may include configuring a plurality of trigger numbers, each associated with a specific function and/or a specific downhole tool 32, 36. At block 154, the assembly 18 is placed in the wellbore 12, substantially similarly to block 102 described above with reference to FIG. 2. At block 156, the assembly 18 is manipulated proximate to the surface to induce motion in the assembly 18 in the wellbore to encode a discrete signal and/or a discrete number.

At block 158, a speed of the assembly 18 proximate to the first down hole tool 32 is determined. For example, the trigger unit subassembly receives indications of the speed of the assembly 18 from speed sensors, processes the indications, and determines a speed of the assembly 18. At block 160, the trigger unit subassembly analyzes the speed of the assembly 18 as it changes over time to decode the discrete signal encoded in the motion imparted to the assembly 18 by manipulation at the surface. In an embodiment, the processing of block 158 and block 160 may be combined. Alternatively, the processing of block 158 and block 160 may loop and/or iterate during receiving of the discrete signal.

At block 162, a function of the downhole tool 32 is triggered by the triggering unit subassembly based on the discrete signal, for example based on the discrete number encoded in the discrete signal matching the trigger number configured in the triggering unit subassembly. The triggering unit subassembly may communicate the trigger signal to an actuating device that forms part of the first downhole tool 32. Alternatively, the triggering unit subassembly may communicate the trigger signal to an actuating device coupled to the first downhole tool 32, for example an actuating device that together with the first down hole tool 32 forms a sub-assembly of the assembly 18. The processing of blocks 156, 158, 160, and 162, optionally, may be repeated a desired number of times to trigger functions of other downhole tools. The method 150 then exits.

Figure 4:
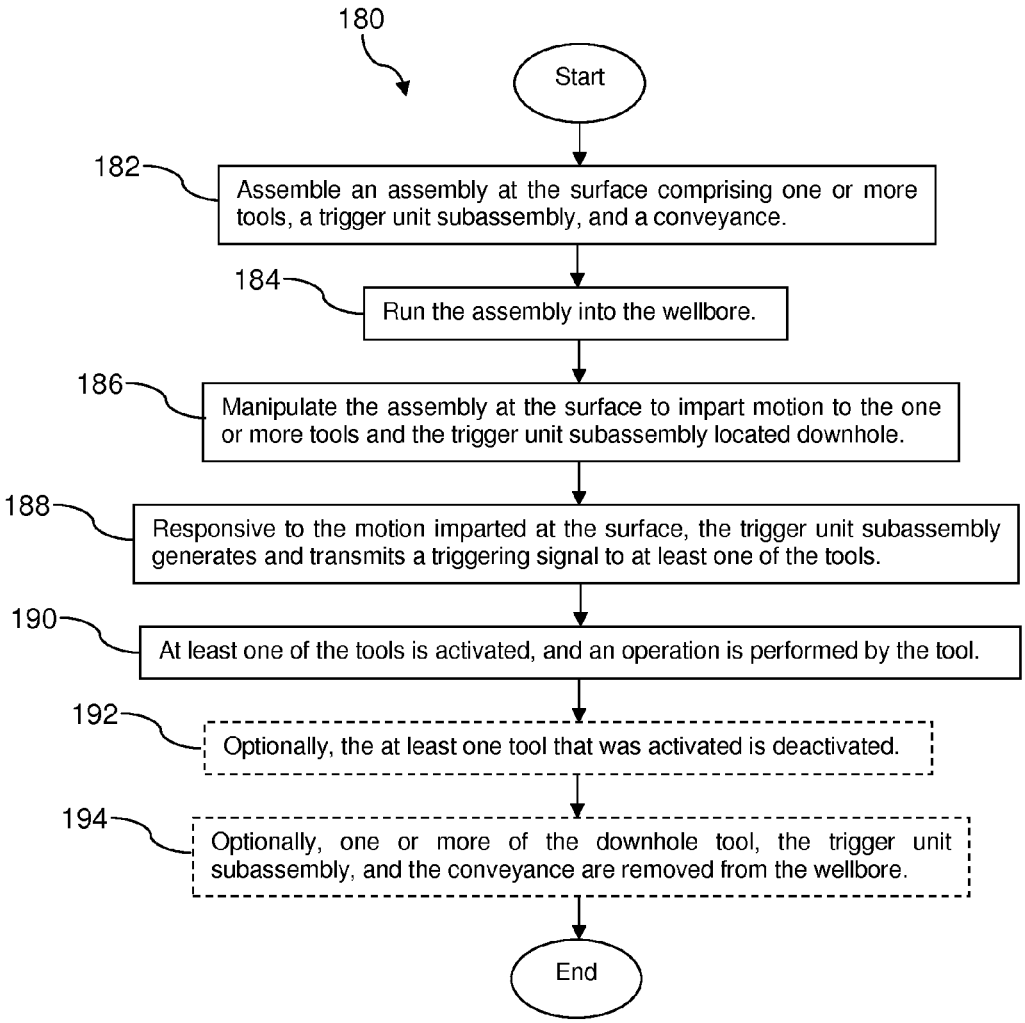
FIG. 4 is a flow chart of another method according to an embodiment of the disclosure.

Turning now to FIG. 4, a method 180 is described. At block 182, an assembly is assembled, made-up, and/or built at the surface comprising one or more tools, a trigger unit subassembly, and a conveyance. For example, the assembly 18 is assembled, made-up, and/or built comprising one or more downhole tools 32, 34, the signal receiver subassembly 34, and the conveyance 30. The downhole tools may comprise completion tools, drilling tools, or other downhole tools. The downhole tools may comprise, but without limitation, a packer, a bridge plug, a float collar, a setting tool, a flow control device, a data collection device, a sampler, a perforating tool a casing cutting tool, a stimulation tool, a fracturing tool, a drill bit, a reamer, a logging tool, a measure while drilling tool, a log while drilling tool, or other tool. It is understood that the downhole tools may comprise and/or be coupled to an actuating device, wherein the actuating device may be triggered to actuate based on a signal output by the signal receiver subassembly. The conveyance 30 may comprise one or more of jointed pipes, wireline, coiled tubing, sandline, slickline, or other mechanical connection. In some contexts, a slickline may be referred to as a solid wire, but the term solid wire may comprise other conveyances not referred to as slickline. In some contexts, a wireline and/or a sandline may be referred to as a braided wire, but the term braided wire may comprise other conveyances not referred to as a sandline or as a braided wire. The assembly 18 may be referred to in different contexts by a variety of names including a completion string, a drilling string, a workstring, a logging string, or other term of art. A triggering number may be configured into the trigger unit subassembly during assembly of the assembly 18. At block 184, the assembly is run into the wellbore 12.

At block 186, the assembly is manipulated at the surface to impart motion to the one or more tools and the trigger unit subassembly located downhole. For example, the rig 16 may pull up and let off on the conveyance 30, thereby moving the assembly 18 in the wellbore 12 and moving the tools and trigger unit subassembly located downhole. The motion may consist of time intervals of motion and time intervals when the motion of the assembly 18 is stopped, encoding a sequence of numbers or symbols as described in more detail above. Additionally, the motion may comprise a framing signal that precedes the encoded sequence of numbers or symbols, as described in more detail previously.

It is understood that the assembly 18 may be deemed to be stopped when the velocity and/or speed of the assembly 18 is below a first threshold value and that the assembly 18 may be deemed to be moving when the velocity and/or speed of the assembly 18 is above a second threshold value. In an embodiment, the assembly 18 comprises an expansion joint located in the assembly 18 proximate to the downhole tools and/or the trigger unit subassembly. In the instance that one of the downhole tools, for example a packer, is fixed in position in the wellbore 12, the expansion joint may permit the motion of the assembly 18 above the expansion joint and promote the propagation of the motion signal to the trigger unit subassembly, for example the generation of mechanical noise.

The motion of the assembly in the wellbore 12 may generate mechanical noise, for example mechanical vibration of the assembly, as the result of friction forces between the assembly and the side walls of the wellbore 12. At block 188, responsive to the motion imparted at the surface, the trigger unit subassembly generates and transmits a triggering signal to at least one of the downhole tools. The trigger unit subassembly may detect the configured trigger number, as described further above. For example, the signal receiver subassembly 34 detects the mechanical vibration as the assembly 18 moves in the wellbore 12, detects the absence of mechanical vibration when the assembly 18 stops moving in the wellbore 12, and decodes the sequence of motion and non-motion as a signal, a number, or a coded message. Alternatively, the signal receiver subassembly 34 may detect that the mechanical vibration of the assembly 18 is above a first defined threshold and associate this condition with movement of the assembly 18 in the wellbore 12 and may detect that the mechanical vibration of the assembly 18 is below a second defined threshold and associate this condition with the absence of motion of the assembly 18 in the wellbore 12.

At block 190, at least one of the downhole tools is activated by the triggering signal, and an operation is performed by the tool. For example, a reamer is deployed in response to the triggering signal, and the reamer widens the drill hole to reduce the risk that the assembly 18 will get stuck in the wellbore 12. For example, a perforation gun is fired in response to the triggering signal, and the casing and formation 14 are perforated. For example, a sleeve of a stimulation tool is moved to open a port to permit flow of stimulation fluid into a portion of the formation 14. For example, a data collection device is activated to begin collecting data, for example a measure while drilling and/or log while drilling device is activated.

At block 192, optionally the tool that was activated is deactivated. For example, in an embodiment, the sleeve of the stimulation tool is moved to close the port to prohibit flow of stimulation fluid. For example, in an embodiment, the data collection device is deactivated and stops collecting data. It is understood, however, that in some embodiments the tool that was activated may remain activated, possibly indefinitely. For example, a bridge plug activated in block 190 may be left activated indefinitely or for an extended period of time. At block 194, optionally the downhole tool or tools, the trigger unit subassembly, and the conveyance are removed from the wellbore 12. It is understood, however, that some downhole tools and/or the trigger unit subassembly may be left in the wellbore 12. Additionally, in an embodiment, the conveyance 30 also may be left in the wellbore 12, for example in the instance that the conveyance 30 comprises, at least in part, production tubing and the wellbore 12 is being placed on production.

Figure 5:
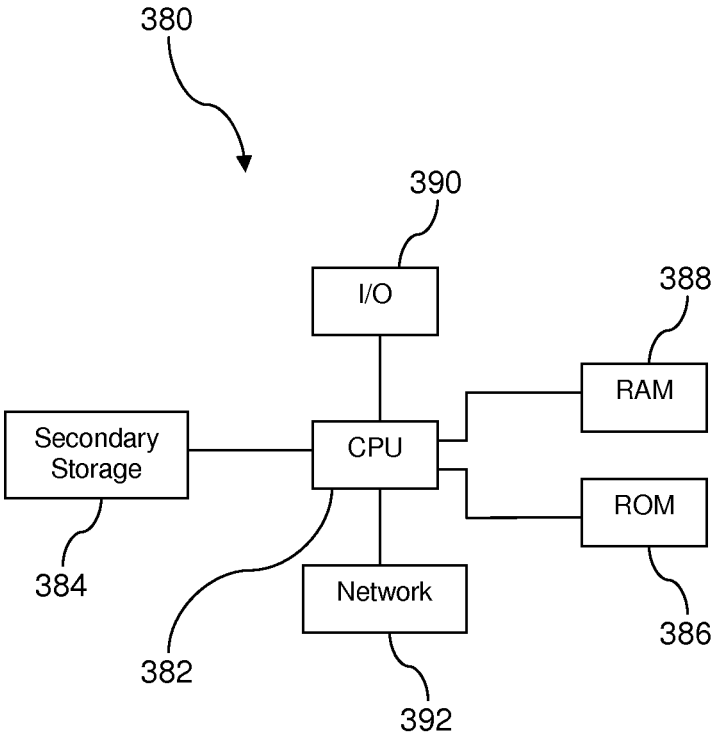
FIG. 5 is an illustration of a computer system suitable for implementing the several embodiments of the disclosure.

FIG. 5 illustrates a computer system 380 suitable for implementing one or more embodiments disclosed herein. The computer system 380 includes a processor 382 (which may be referred to as a central processor unit or CPU) that is in communication with memory devices including secondary storage 384, read only memory (ROM) 386, random access memory (RAM) 388, input/output (I/O) devices 390, and network connectivity devices 392. The processor 382 may be implemented as one or more CPU chips.

It is understood that by programming and/or loading executable instructions onto the computer system 380, at least one of the CPU 382, the RAM 388, and the ROM 386 are changed, transforming the computer system 380 in part into a particular machine or apparatus having the novel functionality taught by the present disclosure. It is fundamental to the electrical engineering and software engineering arts that functionality that can be implemented by loading executable software into a computer can be converted to a hardware implementation by well known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

The secondary storage 384 is typically comprised of one or more disk drives or tape drives and is used for non-volatile storage of data and as an over-flow data storage device if RAM 388 is not large enough to hold all working data. Secondary storage 384 may be used to store programs which are loaded into RAM 388 when such programs are selected for execution. The ROM 386 is used to store instructions and perhaps data which are read during program execution. ROM 386 is a non-volatile memory device which typically has a small memory capacity relative to the larger memory capacity of secondary storage 384. The RAM 388 is used to store volatile data and perhaps to store instructions. Access to both ROM 386 and RAM 388 is typically faster than to secondary storage 384.

I/O devices 390 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA), global system for mobile communications (GSM), long-term evolution (LTE), and/or worldwide interoperability for microwave access (WiMAX) radio transceiver cards, and other well-known network devices. These network connectivity devices 392 may enable the processor 382 to communicate with an Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave.

Such information, which may include data or instructions to be executed using processor 382 for example, may be received from and outputted to the network, for example, in the form of a computer data baseband signal or signal embodied in a carrier wave. The baseband signal or signal embodied in the carrier wave generated by the network connectivity devices 392 may propagate in or on the surface of electrical conductors, in coaxial cables, in waveguides, in optical media, for example optical fiber, or in the air or free space. The information contained in the baseband signal or signal embedded in the carrier wave may be ordered according to different sequences, as may be desirable for either processing or generating the information or transmitting or receiving the information. The baseband signal or signal embedded in the carrier wave, or other types of signals currently used or hereafter developed, referred to herein as the transmission medium, may be generated according to several methods well known to one skilled in the art.

The processor 382 executes instructions, codes, computer programs, scripts which it accesses from hard disk, floppy disk, optical disk (these various disk based systems may all be considered secondary storage 384), ROM 386, RAM 388, or the network connectivity devices 392. While only one processor 382 is shown, multiple processors may be present. Thus, while instructions may be discussed as executed by a processor, the instructions may be executed simultaneously, serially, or otherwise executed by one or multiple processors.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of servicing a wellbore extending from a surface and penetrating a subterranean formation, comprising:

placing an assembly in the wellbore, wherein the assembly comprises at least a first downhole tool, a signal receiver subassembly, and a conveyance between the first downhole tool and the surface, wherein the first down hole tool and the signal receiver subassembly are coupled to a downhole end of the conveyance;

transmitting a first velocity signal by axially moving the assembly in the wellbore proximate to the surface, wherein transmitting the first velocity signal comprises axially moving the assembly to transmit a first discrete value and maintaining the assembly stationary to transmit a second discrete value and wherein the first velocity signal encodes a first discrete number as a sequence of discrete values;

receiving by the signal receiver subassembly the first velocity signal generated by contact between the wellbore and the assembly proximate to the first downhole tool; and initiating a first function of the first downhole tool based on the first velocity signal.

2. The method of claim 1, wherein the first down hole tool comprises one of a packer, a bridge plug, a setting tool, a flow control device, a data collection device, a sampler, a perforating tool, a casing cutting tool, a stimulation tool, a fracturing tool, a drill bit, a reamer, a logging tool, a measure while drilling tool, a log while drilling tool, and a float collar.

3. The method of claim 1, further comprising:

transmitting a second velocity signal, the second velocity signal generated by contact between the wellbore and the assembly by axially moving the assembly in the wellbore proximate to the surface, wherein the second signal encodes a second discrete number that is distinct from the first discrete number;

receiving by the signal receiver subassembly the second velocity signal; and initiating a second function of the first downhole tool based on the second velocity signal.

4. The method of claim 1, wherein the assembly further comprises a second downhole tool, further comprising:

transmitting a third velocity signal, the third velocity signal generated by contact between the wellbore and the assembly by axially moving the assembly in the wellbore proximate to the surface, wherein the third velocity signal encodes a third discrete number, the third discrete number distinct from the first discrete number;

receiving by the signal receiver subassembly the third velocity signal; and initiating a third function of the second downhole tool based on the third velocity signal.

5. The method of claim 1, further comprising filtering the first velocity signal to substantially reject sub-audio frequency components of the first velocity signal, wherein initiating the first function of the first downhole tool is based on the filtered first velocity signal.

6. The method of claim 5, wherein the filtering of the first velocity signal substantially rejects frequency components of the first velocity signal having a frequency less than about 200 Hertz.

7. The method of claim 5, wherein the filtering of the first velocity signal substantially rejects frequency components of the first velocity signal having a frequency less than about 500 Hertz.

8. The method of claim 1, wherein the conveyance comprises at least one of a string of pipe joints, a solid wire, a braided wire, and coiled tubing.

9. The method of claim 1, wherein the signal receiver subassembly further comprises a vibration sensor to sense the first velocity signal.

10. The method of claim 1, wherein the assembly further comprises a mechanical vibration source configured to induce at least a portion of the mechanical vibration when the assembly moves in the wellbore.

11. The method of claim 1, further comprising configuring the first discrete value into the signal receiver subassembly.

12. The method of claim 1, further comprising sensing pressure, wherein the first function of the down hole tool is inhibited from initiation when a sensed pressure is less than 10 atmospheres.

13. A method of servicing a wellbore extending from a surface and penetrating a subterranean formation, comprising:

placing an assembly in the wellbore, wherein the assembly comprises at least a first downhole tool, a signal receiver subassembly, a conveyance between the first downhole tool and the surface, and a mechanical vibration source configured to induce a mechanical vibration when the assembly moves in the wellbore, wherein the first down hole tool, the signal receiver subassembly, and the mechanical vibration source are coupled to a downhole end of the conveyance;

transmitting a first velocity signal by axially moving the assembly in the wellbore proximate to the surface, wherein transmitting the first velocity signal comprises axially moving the assembly to transmit a first discrete value and maintaining the assembly stationary to transmit a second discrete value and wherein the first velocity signal encodes a first discrete number as a sequence of discrete values;

receiving by the signal receiver subassembly the first velocity signal, wherein the signal receiver infers the first velocity signal from a mechanical vibration generated by contact between the wellbore and the assembly proximate to the first downhole tool; and initiating a first function of the first downhole tool based on the first velocity signal.

14. The method of claim 13, wherein the mechanical vibration source is an extended probe.

15. The method of claim 13, wherein the mechanical vibration source is configured to provide a consistent mechanical vibration.

16. The method of claim 13, wherein the mechanical vibration source is configured to produce a mechanical vibration having a selected main frequency bandwidth.

17. The method of claim 13, wherein the mechanical vibration source is configured to produce a mechanical vibration having a selected alignment.

18. A method of servicing a wellbore extending from a surface and penetrating a subterranean formation, comprising:

placing an assembly in the wellbore, wherein the assembly comprises at least a first downhole tool, a signal receiver subassembly, a conveyance between the first downhole tool and the surface, and a mechanical vibration source configured to induce a mechanical vibration having a selected main frequency bandwidth when the assembly moves in the wellbore, wherein the first down hole tool, the signal receiver subassembly, and the mechanical vibration source are coupled to a downhole end of the conveyance;

transmitting a first velocity signal by axially moving the assembly in the wellbore proximate to the surface, wherein transmitting the first velocity signal comprises moving the assembly to transmit a first discrete value and maintaining the assembly stationary to transmit a second discrete value and wherein the first velocity signal encodes a first discrete number as a sequence of discrete values;

receiving by the signal receiver subassembly the first velocity signal, wherein the signal receiver infers the first velocity signal from a mechanical vibration generated by contact between the wellbore and the workstring proximate to the first downhole tool; and initiating a first function of the first downhole tool based on the first velocity signal.

19. The method of claim 18, wherein the mechanical vibration source is further configured to provide a consistent mechanical vibration.

20. The method of claim 19, wherein the mechanical vibration source is further configured to produce a mechanical vibration having a selected alignment.

* * * * *